US005634585A

United States Patent [19]

Stansbury

[11] Patent Number: 5,634,585

[45] Date of Patent: Jun. 3, 1997

[54] METHOD FOR ALIGNING AND ASSEMBLING SPACED COMPONENTS

[75] Inventor: Darryl Stansbury, Boise, Id.

[73] Assignee: Micron Display Technology, Inc., Boise, Id.

[21] Appl. No.: 553,798

[22] Filed: Oct. 23, 1995

[51] Int. Cl.[6] ..... H01J 1/88

[52] U.S. Cl. ..... 228/105; 228/177; 156/64; 445/24

[58] Field of Search ..... 228/103, 105, 228/177; 445/24; 156/64; 29/593, 833; 356/243

[56] References Cited

U.S. PATENT DOCUMENTS

| | | | |
|---|---|---|---|
| 3,997,963 | 12/1976 | Riseman | 29/578 |
| 4,899,921 | 2/1990 | Bendat et al. | 228/105 |
| 5,186,670 | 2/1993 | Doan et al. | 445/24 |
| 5,205,770 | 4/1993 | Lowrey et al. | 445/24 |
| 5,210,472 | 5/1993 | Casper et al. | 315/349 |
| 5,213,676 | 5/1993 | Reele et al. | 205/118 |
| 5,229,331 | 7/1993 | Doan et al. | 437/228 |
| 5,302,238 | 4/1994 | Roe et al. | 156/643 |
| 5,547,537 | 8/1996 | Reynolds et al. | 156/351 |
| 5,570,184 | 10/1996 | Armington et al. | 228/105 |

OTHER PUBLICATIONS

"Calibration of the M–8B", Operation Manual for Research Devices M–8B Aligner Bonder, 1990, pp. 1–12.

*Primary Examiner*—Samuel M. Heinrich
*Attorney, Agent, or Firm*—Stephen A. Gratton

[57] ABSTRACT

A method for aligning and bonding spaced components, such as a baseplate and a faceplate of a field emission display, is provided. The method includes: providing an optical alignment tool suitable for flip chip bonding; calibrating the tool to simulate a desired spacing in the assembled components; aligning the components using the calibrated tool; bringing the aligned components towards one another using the calibrated tool; and then bonding the components together with the desired spacing therebetween. The method of the invention can be practiced with an aligner bonder tool calibrated to eliminate a parallax error. A spacer element placed between the bondheads of the tool can be used to simulate the desired spacing during calibration. Alternately the spacing during calibration can be simulated by measuring with a caliper or other instrument.

20 Claims, 2 Drawing Sheets

METHOD FOR ALIGNING AND ASSEMBLING SPACED COMPONENTS

This invention was made with Government support under Contract No. MDA972-92-C-0054 awarded by Advanced Research Projects Agency (ARPA). The Government has certain rights in this invention.

FIELD OF THE INVENTION

This invention relates generally to optical alignment systems and more particularly to a method for optically aligning and assembling spaced components such as the baseplate and faceplate of a field emission display.

BACKGROUND OF THE INVENTION

Flat panel displays have recently been developed for visually displaying information generated by computers and other electronic devices. These displays can be made lighter and require less power than conventional cathode ray tube displays. One type of flat panel display is known as a cold cathode field emission display (FED).

A field emission display uses electron emissions to illuminate a cathodoluminescent display screen (termed herein a "faceplate") and generate a visual image. An individual field emission pixel typically includes emitter sites formed on a baseplate. The baseplate includes the circuitry and devices that control electron emission from the emitter sites. A gate electrode structure, or grid, is associated with the emitter sites. The emitter sites and grid are electrically connected to a voltage source. The voltage source establishes a voltage differential between the emitter sites and grid and controls electron emission from the emitter sites. The emitted electrons pass through a vacuum space and strike phosphors contained on the display screen. The phosphors are excited to a higher energy level and release photons to form an image. In this system the display screen is the anode and the emitter sites are the cathode. The emitter sites and faceplate are spaced apart by a small distance to stand off the voltage difference between these components and to provide a gap for gas flow. In order to provide a uniform resolution, focus and brightness at the faceplate, it is important that this distance be uniform across the total surface of the faceplate. In addition, in order to achieve reliable display operation during electron emission from the emitter sites, a vacuum on the order of $10^{-6}$Torr or less is required. The vacuum is formed in a sealed space contained within the field emission display.

Field emission displays are typically constructed as a package having a seal for sealing the space between the baseplate and faceplate. However, prior to sealing of the package it is necessary to align the baseplate with the faceplate. This is required so that elements on the baseplate (e.g., emitter sites) are in alignment with corresponding elements on the faceplate.

One difficulty with the process for aligning the baseplate and faceplate is that because these components are ultimately assembled in a spaced or offset configuration, alignment errors introduced during the alignment process are magnified by the spacing of the assembled components. These errors are termed herein as "parallax" errors because they are caused by a different viewpoint during the alignment and bonding steps. As an example, the baseplate and faceplate can be initially spaced apart, optically aligned, and then brought into a final spaced configuration during assembly. However, misalignment during the initial alignment procedure can introduce parallax errors in the assembled components that cannot be tolerated in a field emission display.

In view of the foregoing, it is an object of the present invention to provide an improved method for aligning and assembling spaced components such as the baseplate and faceplate of a field emission display.

It is a further object of the present invention to provide an improved method for aligning and assembling spaced components using an optical alignment tool calibrated to reduce parallax alignment errors.

It is yet another object of the present invention to provide an improved method for calibrating conventional alignment tools to eliminate parallax errors to permit their use in aligning and assembling spaced components.

Other objects, advantages and capabilities of the present invention will become more apparent as the description proceeds.

SUMMARY OF THE INVENTION.

In accordance with the present invention, an improved method for aligning and assembling spaced components to eliminate parallax errors is provided. In an illustrative embodiment the method is used for aligning the faceplate and baseplate of a field emission display. The method, simply stated, comprises: providing an alignment tool suitable for flip chip bonding semiconductor dice to a substrate; calibrating the tool to simulate the spacing of the assembled components; and then using the tool to align and assemble the components.

One suitable alignment tool is described in U.S. Pat. No. 4,899,921 to Bendat et al., which is incorporated herein by reference. This tool is manufactured by Research Devices Inc. of Pistcataway, New Jersey and is designated an M-8A aligner bonder. Such an alignment tool is conventionally used to flip chip mount a semiconductor die to a supporting substrate such as a printed circuit board. The alignment tool includes a bondhead for the die and a bondhead for the supporting substrate. Both of the bondheads can be moved in a z-direction, in orthogonal x and y directions, in a rotational direction theta and in angles of inclination $\phi$ and $\psi$. The alignment tool also includes an optical probe movable to view the spaced surfaces of the die and supporting substrate. The optical probe is under computer control and communicates a visual image to a video camera or microscope system for viewing by an operator.

This type of alignment tool must be calibrated before use. Typically a pair of calibration reticles is used to calibrate the alignment tool. During the calibration procedure, a stationary calibration reticle is mounted on the tool in place of one of the bondheads. A target calibration reticle is then placed on the other bondhead. The bondhead is then manipulated so that the two calibration reticles are very close together (e.g.,0.015625 inches). The tool is then adjusted so that alignment marks on the calibration reticles are coincident with one another.

With the present method, in order to simulate the spacing of the assembled components, this spacing is maintained during the calibration process. In a dual reticle calibration system, a spacer can be placed between the two calibration reticles during the calibration procedure. The spacer can be formed of a transparent material (e.g., glass) or can be a frame with an open interior. Alternately in lieu of a spacer, the calibration reticles can be spaced an exact amount during the calibration procedure using a micrometer or other measuring instrument. This calibration procedure eliminates a parallax error occurring when the alignment plane is not on the same plane as the bonding plane.

Another suitable alignment tool for practicing the method of the invention is manufactured by Karl Suss and is designated a model FC 150 aligner bonder. The Karl Suss tool includes a bondhead for one component (e.g., die), a bond head for the mating component (e.g., substrate), and an associated computer controlled optical system. With the Karl Suss alignment tool, a single calibration reticle is used for calibration. The normal procedure is to align one of the bondheads using the calibration reticle and optical system and then to separately align the other bondhead. During this process the calibration reticle is placed on one of the bondheads and the tool is adjusted to make reference marks on the calibration reticle align with an internal optical image. The bondheads are then brought together and the reticle automatically transfers between the bondheads by control of vacuum conduits coupled to the bondheads. The location of the second bond head is then adjusted so that the alignment reticle aligns with the internal optical image.

In accordance with the method of the invention, with an alignment tool that uses a single calibration reticle, a spacer is attached to the calibration reticle. During the calibration process the spacer separates the bondheads from the calibration reticle by an exact amount.

DETAILED DESCRIPTION OF THE PREFERRED EMBODIMENTS

Figure 1:
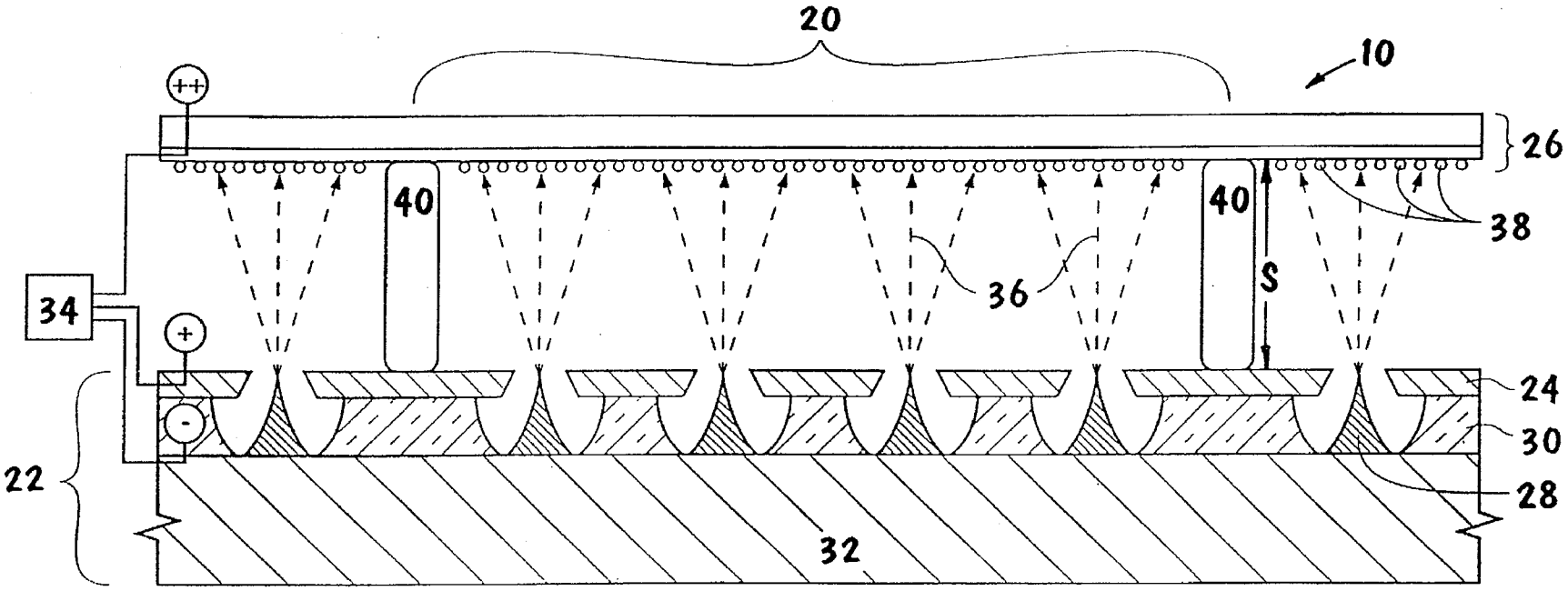
FIG. 1 is a schematic cross sectional view of a field emission display having parallel spaced components aligned in accordance with the invention.

Referring now to FIG. 1, components of a field emission display 10 are shown. In FIG. 1 an enlarged view of a display segment 20 of the field emission display 10 is shown. Each display segment 20 is capable of displaying a pixel of an image (or a portion of a pixel). The field emission display 10 includes a baseplate 22 and a faceplate 26.

The baseplate 22 includes a substrate 32, formed of a material such as single crystal silicon, or alternately amorphous silicon deposited on a glass substrate. A plurality of field emitter sites 28 are formed superjacent to substrate 32. A grid 24 surrounds the emitter sites 28 and is electrically insulated and spaced from the substrate 32 by an insulating layer 30.

A source 34 is electrically connected to the emitter sites 28, to the grid 24 and to the faceplate 26. The faceplate 26 is separated from the baseplate 22 by spacers 40. When a voltage differential is applied by the source 34, a stream of electrons 36 is emitted by the emitter sites 28 towards the faceplate 26. In this system the faceplate 26 is the anode and the emitter sites 28 are the cathode. The electrons 36 emitted by the emitter sites 28 strike phosphors 38 of faceplate 26. This excites the phosphors 38 to a higher energy level. Photons are released as the phosphors 38 return towards their original energy level. U.S. Pat. No. 5,302,238 to Roe et al.; U.S. Pat. No. 5,210,472 to Casper et al.; U.S. Pat. No. 5,232,549 to Cathey et al.; U.S. Pat. No. 5,205,770 to Lowrey et al.; U.S. Pat. No. 5,186,670 to Doan et al.; and U.S. Pat. No. 5,229,331 to Doan et al.; all of which are incorporated by reference disclose methods for forming various elements of field emission displays.

During the assembly process, the baseplate 22 is aligned with the faceplate 26 such that components on the baseplate 22 (e.g., emitter sites 28) align with corresponding components (e.g., phosphors 38) on the faceplate 26. In accordance with the invention, this alignment process is accomplished using an optical alignment tool suitable for flip chip mounting a semiconductor die.

During this alignment process the baseplate 22 is placed on one bondhead of the tool and the faceplate 26 is placed on the other bondhead of the tool. The baseplate 22 and faceplate 26 are aligned and brought together by manipulation of the tool and then bonded to one another using a suitable process. The baseplate 22 can be bonded to the faceplate 26 using a thermosonic bonding process or a gluing process. By way of example, glue dots can be screen printed on the faceplate 26 to contact the spacers 40 attached to the baseplate 22. U.S. Pat. No. 08/488,704 which is incorporated herein by reference, discloses a method for screen printing an adhesive material on the faceplate 26 or baseplate 22.

Alignment fiducials formed on the baseplate 22 and faceplate 26 can be used as reference locations during the alignment process. In place of or in conjunction with the alignment fiducials, readily visible features such as the spacers 40, can be used for reference. These alignment fiducials are viewable using the optics of the tool. The bondheads of the tool are then manipulated to align and bring the baseplate 22 and faceplate 26 together. The spacing "S" (FIG. 1) between the baseplate 22 and faceplate 26 in the assembled FED is typically on the order of 100–200μm. Using the method of the invention, this spacing is simulated during calibration of the aligner bonder tool.

Figure 2:
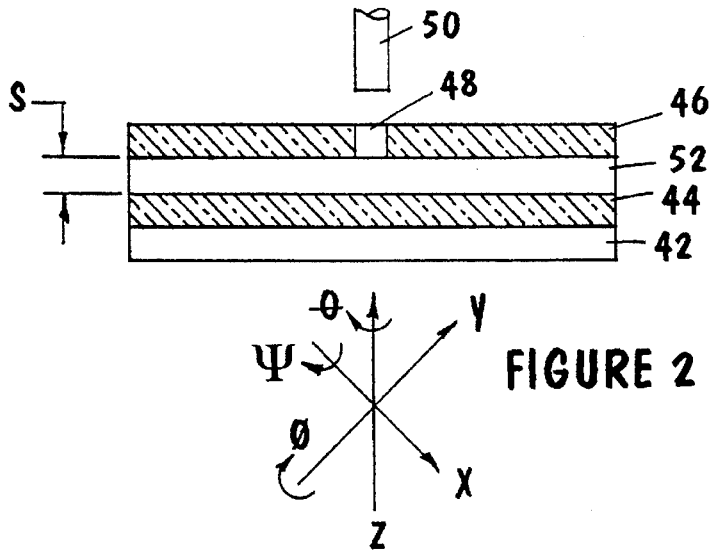
FIG. 2 is a schematic view of a calibration procedure for an optical alignment tool that uses a pair of calibration reticles.

Referring now to FIG. 2, the calibration procedure for a two reticle alignment system such as the Research Devices M-8 aligner bonder tool (U.S. Pat. No. 4,899,921) previously described is shown. As previously described, a bondhead 42 for the aligner bonder tool is movable in a z-direction, in orthogonal x and y directions, in a rotational direction theta and in angles of inclination $\psi$ and $\phi$. As described in U.S. Pat. No. 4,899,921 at column 8, line 20 -column 9, line 31, during a calibration procedure, a target reticle 44 is placed on the bondhead 42. As also described in the above patent, a stationary calibration reticle 46 with an opening 48 is mounted to the tool using a calibration reticle mount. Microscope optics 50 are associated with a calibration bridge mounted to the tool. During the calibration procedure, the location of the bondhead 42 is adjusted so that reference marks on the target reticle 44 align with corresponding reference marks on the calibration reticle 46.

In accordance with the present invention, a spacer 52 is placed between the target reticle 44 and the calibration reticle 46 during the calibration procedure to eliminate a parallax error. The spacer 52 has a thickness "S" that is approximately equal to the spacing "S" (FIG. 1) between the faceplate 26 and baseplate 22 in the assembled FED. With the spacer 40 in place during the calibration procedure, an offset equivalent to the offset "S" in the assembled FED is simulated. Following the calibration procedure, the target reticle 44 and calibration reticle 46 are removed and the aligner bonder tool is used to align the baseplate 22 and faceplate 26 (FIG. 1) and to bring these components together for bonding (e.g., gluing).

Figure 3A:
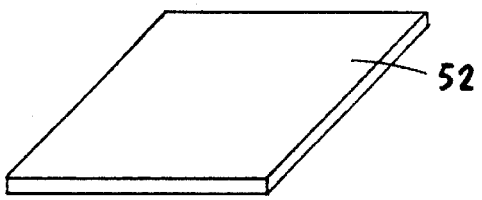
FIG. 3A is a perspective view of a transparent spacer for use with the method of the invention.

FIG. 3A illustrates the spacer 52 formed of a transparent material such as glass. By way of example, microscope slides can be utilized having a thickness that is approximately equal to the spacing "S" (e.g., 100–200 μm). A transparent spacer 52 permits the target reticle 44 to be viewed during the calibration process.

Figure 3B:
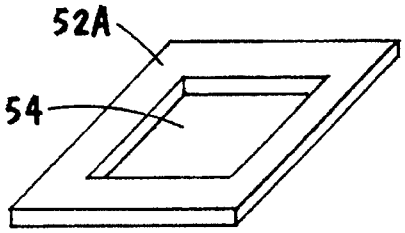
FIG. 3B is a perspective view of a frame spacer for use with the method of the invention.

Alternately, as shown in FIG. 3B, a framed spacer 52A can be used in place of a transparent spacer 52. The framed spacer 52A includes an open or hollow interior portion 54 that separates the target reticle 42 and calibration reticle 46 yet permits the target reticle 42 to be viewed during the calibration process.

Alternately in place of a spacer 52 (or 52A), the spacing "S" (FIG. 2) can be achieved during calibration by mechanical measurement. In this case, a caliper or other measurement tool can be used to precisely space the target reticle 44 and calibration reticle 46 during the calibration procedure.

Figure 4:
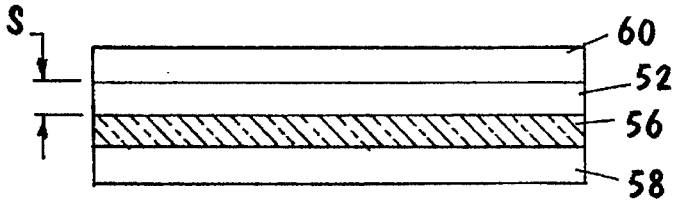
FIG. 4 is a schematic view of a calibration procedure for an optical alignment tool that uses a single calibration reticle.

Referring now to FIG. 4, the method of the invention is illustrated with an aligner bonder tool such as the Karl Suss FC 150 alignment tool previously described that utilizes a single alignment reticle. In this case, the spacer 52 or 52A is attached to the calibration reticle 56 and the calibration reticle 56 is placed on a lower bondhead 58 for the tool. A suitable adhesive can be utilized to attach the spacer 52 or 52A to the calibration reticle 56. A vacuum directed through a conduit (not shown) holds the calibration reticle 56 on the lower bondhead 58 while the location of the bondhead 58 is adjusted. During this calibration procedure, alignment marks on the calibration reticle 56 are aligned with a corresponding image internally generated by the system optics.

Once the location of the lower bondhead 58 has been adjusted to align with the internal image, an upper bondhead 60 is aligned. This is accomplished by bringing the bondheads 58 and 60 together and then aligning bondhead 60 using the calibration reticle 56 and internal image. During this calibration process, the spacer 52 or 52A simulates the spacing between the baseplate 22 and faceplate 26 in the assembled FED. As previously described, this spacing can also be simulated by using a measured separation distance rather than a spacer 52 or 52A.

Thus the invention provides an improved method for aligning and assembling parallel spaced components such as the baseplate and faceplate of a FED. While the invention has been described with reference to certain preferred embodiments, as will be apparent to those skilled in the art, certain changes and modifications can be made without departing from the scope of the invention as defined by the following claims.

What is claimed is:

1. A method for aligning a first component with a second component, said method comprising:

providing an optical alignment tool;

calibrating the tool by simulating a desired spacing between the components during a calibration process;

aligning the first and second components using the calibrated tool; and bringing the first and second components together with the desired spacing using the calibrated tool.

2. The method as claimed in claim 1 and wherein simulating the desired spacing is with a spacer element.

3. The method as claimed in claim 1 and wherein simulating the desired spacing is by measuring.

4. The method as claimed in claim 1 and wherein a calibration reticle is used to calibrate the tool.

5. The method as claimed in claim 1 and wherein the first and second components are a baseplate and a faceplate of a field emission display.

6. A method for aligning and assembling a first component to a second component with a desired spacing therebetween, said method comprising:

providing an aligner bonder tool including a first bondhead and a second bondhead;

calibrating the tool to eliminate a parallax error by simulating the desired spacing between the bondheads during a calibration process;

placing the first component on the first bondhead and the second component on the second bondhead;

aligning reference locations on the first component with reference locations on the second component by adjusting a location of the first or second bondhead; and bringing the first and second components towards one another to the desired spacing by moving the first or second bondheads towards one another.

7. The method as claimed in claim 6 and further comprising bonding the first component to the second component.

8. The method as claimed in claim 6 and wherein calibrating the tool is with a first calibration reticle attached to the tool and a second calibration reticle attached to the first bondhead and separated from the first calibration reticle by a spacer.

9. The method as claimed in claim 8 and wherein the spacer is a transparent element.

10. The method as claimed in claim 8 and wherein the spacer is a frame element having an open interior portion.

11. The method as claimed in claim 6 and wherein calibrating the tool is with a single calibration reticle separated from the first or second bondhead by a spacer.

12. The method as claimed in claim 11 and wherein the spacer is a transparent element.

13. The method as claimed in claim 11 and wherein the spacer is a frame element having an open interior portion.

14. The method as claimed in claim 6 and wherein the first and second components are a baseplate and a faceplate of a field emission display.

15. A method for aligning and assembling a first component with a second component with a desired spacing therebetween, said method comprising:

providing an aligner bonder tool having a first bondhead and a second bondhead;

calibrating the tool to eliminate a parallax error using a calibration reticle and aligning one of the bondheads using the calibration reticle while the desired spacing is maintained between the first and second bondhead;

placing the first component on the first bondhead and the second component on the second bondhead and aligning reference locations on the first component with reference locations on the second component;

bringing the first and second components towards one another using the first or second bondheads; and bonding the first component and the second component to one another with the desired spacing therebetween.

16. The method as recited in claim 15 and wherein calibrating the tool is with a single calibration reticle and a spacer is attached to the calibration reticles.

17. The method as recited in claim 15 and wherein calibrating the tool is with a pair of calibration reticles and a spacer is placed between the calibration reticles.

18. The method as recited in claim 15 and wherein the first component is a baseplate of a field emission display and the second component is a faceplate of a field emission display.

19. The method as recited in claim 18 and wherein the baseplate and faceplate are bonded by gluing spacers to the baseplate and faceplate.

20. The method as recited in claim 19 and wherein the desired spacing is from 100–200 μm.

* * * * *